United States Patent [19]

Chheda

[11] Patent Number: 4,527,580

[45] Date of Patent: Jul. 9, 1985

[54] VOLUME CONTROL DEVICE

[75] Inventor: Nemjee R. Chheda, Rockford, Ill.

[73] Assignee: Sundstrand Corporation, Rockford, Ill.

[21] Appl. No.: 554,946

[22] Filed: Nov. 25, 1983

[51] Int. Cl.[3] ..... F15B 1/06

[52] U.S. Cl. ..... 137/1; 60/478; 137/115; 137/565; 137/568; 138/30; 251/61.3

[58] Field of Search ..... 60/478; 137/565, 568, 137/1, 115; 138/30, 31; 417/279, 307; 251/61.3

[56] References Cited

U.S. PATENT DOCUMENTS

| | | | |
|---|---|---|---|
| 2,009,102 | 7/1935 | Bern . | |
| 2,043,798 | 6/1936 | Hyatt . | |
| 2,044,443 | 6/1936 | Ott . | |
| 2,216,296 | 10/1940 | Raymond et al. . | |
| 2,365,650 | 12/1944 | Shaw | 251/61.3 X |
| 2,573,231 | 10/1951 | Teague | 137/115 X |
| 2,809,596 | 10/1957 | Sullwold | 60/478 X |
| 2,844,165 | 7/1958 | Morse . | |
| 2,852,033 | 9/1958 | Orser | 138/30 X |
| 2,871,870 | 2/1959 | Peters . | |
| 3,114,387 | 12/1963 | Barkan et al. . | |
| 3,236,258 | 2/1966 | Teston . | |
| 3,336,948 | 8/1967 | Lucien | 138/31 |
| 3,456,673 | 7/1969 | Legrand | 138/30 X |
| 3,693,348 | 9/1972 | Mercier | 138/30 X |
| 3,886,969 | 6/1975 | Shira et al. | 137/509 |
| 3,935,882 | 2/1976 | Matthews | 138/30 |
| 4,052,852 | 10/1977 | Hart | 138/30 X |
| 4,167,198 | 9/1979 | Kotyza et al. | 137/528 |
| 4,245,668 | 1/1981 | Lindstrom | 137/534 |

*Primary Examiner*—Robert G. Nilson

*Attorney, Agent, or Firm*—Wood, Dalton, Phillips, Mason & Rowe

[57] ABSTRACT

A volume control device for a sealed reservoir for storing oil under pressure and which supplies oil to a power circuit. The volume control device has an expansible bellows assembly which contracts upon a predetermined increase of volume of oil in the reservoir to bring a rod into engagement with a ball check valve and unseat the valve for dumping of oil overboard from the reservoir. The dumping of excess oil from the reservoir is controlled by an increase of volume of oil in the reservoir, rather than an increase in oil pressure.

17 Claims, 2 Drawing Figures

VOLUME CONTROL DEVICE

DESCRIPTION

1. Technical Field

This invention pertains to a volume control device for a reservoir which stores oil under pressure during operation of a supply system for a closed oil circuit. The supply system, when used as a hydraulic power circuit for actuators, such as missile guidance controls, typically includes a relatively large oil volume in a reservoir to act as a heat sink. The oil expands as the temperature increases during operation and this expansion within the reservoir is initially accommodated by the contraction of a bellows assembly. The improvement embodies the use of a check valve which opens in response to a predetermined oil volume increase in the reservoir to dump oil overboard. The check valve does not respond to a pressure increase in the reservoir.

2. Background Art

In a hydraulic power circuit as used, for example, with missile guidance controls, a relatively large amount of oil is stored in a reservoir to act as a heat sink. Upon start-up of the circuit, the oil is pumped from the reservoir to a user device and returned to the reservoir with the temperature of the oil increasing and, therefore, the volume of oil within the reservoir of the closed system increases.

The known system has included a piston within the reservoir which is connected to a bellows assembly. The piston has pump outlet pressure applied thereto and, upon start-up, acts to expand the bellows to increase the pressure of oil within the reservoir and thus prevent cavitation at the inlet of a pump supplied with oil from the reservoir. During operation, the bellows assembly can contract as oil volume in the reservoir increases. A relief valve has been associated with the reservoir which opens, in response to a pressure increase, to dump excess oil overboard after the bellows has contracted to its stroke limit. This reduces the size requirement for the bellows assembly, with a resulting reduction in weight thereof. This relief valve operates dependent upon the pressure of the oil within the reservoir and is set to relieve at a pressure only slightly above normal reservoir pressure during operation and must have low hysteresis so that the maximum reservoir pressure is kept low to minimize the design pressure of the reservoir and thus minimize the structural weight of the reservoir.

The relief valve that has been used to dump excess oil overboard has been of the type having low net seating forces and has a very small contact area sharp seat and, therefore, the relief valve is subject to static leakage of oil overboard during long-term, non-operating storage. The sharp seat can also cause "nibbling" of an O-ring seat which increases the static leakage.

When the reservoir is supplying oil to plural user devices having unequal areas and which are cycled rapidly, there can be large pressure spikes in the reservoir even with the relief valve which requires an increase in the strength and weight of the reservoir.

Although there are many structures in the prior art showing a bellows assembly operative for either directly or indirectly causing change in position of a valve, these known prior art devices are operative in response to pressure of a sensed fluid, rather than to a change in volume thereof.

DISCLOSURE OF THE INVENTION

A primary feature of the invention is to provide a volume control device for a reservoir wherein the volume of oil in the reservoir is limited by operation of an oil dump valve which is actuated by change of oil volume in the reservoir, rather than change of pressure of the oil. This enables the use of a check valve as the dump valve to provide reliable static sealing during prolonged storage.

Another feature of the invention is to provide a volume change device for a reservoir utilizing an expansible member, such as a bellows assembly, which is urged toward an expanded position by a pressure related to that within the reservoir and which contracts upon an increase in volume of oil within the reservoir and, after a predetermined contraction, effects the opening of a dump valve to dump excess oil overboard. The action of opening the dump valve may occur before the bellows assembly is fully compressed, thus allowing some additional compression of the bellows assembly to accommodate rapid volume changes that may occur in the reservoir. This avoids the occurrence of pressure spikes in the reservoir and thus aids in minimizing the strength and weight requirements of the reservoir.

An object of the invention is to provide a supply system for a closed oil circuit having means for pumping oil from a reservoir for use and, thereafter, returning the pumped oil to the reservoir, and with the reservoir provided with the volume control device.

Still another object of the invention is to provide a supply system for a closed oil circuit comprising, an oil reservoir for holding oil under pressure, means in the circuit for pumping oil from the reservoir for use and thereafter returning the pumped oil to the reservoir, a normally closed dump valve for discharging oil from the reservoir, and means responsive to a predetermined increase in volume of oil in the reservoir for opening the dump valve.

Still another object of the invention is to provide a supply system for a closed oil circuit having a sealed reservoir stored full of oil and a pump having an inlet connected to the reservoir for supplying oil under pressure to a user device with return of oil from the user device to the reservoir comprising, an expansible bellows positioned in the reservoir, a rod connected to the bellows, a piston and cylinder in said reservoir with said piston being on said rod, means connecting the pressure side of the pump to said cylinder whereby oil under pressure acts on said piston in a direction to expand said bellows to increase the pressure of the oil in the reservoir upon start-up of the pump and resists contraction of the bellows during operation, and volume-responsive means for limiting the increase of volume of oil in the reservoir during operation of the pump.

A large volume of oil may be stored in a sealed reservoir which, during operation, provides a heat sink and because of the increase in temperature of the oil the volume thereof expands. A certain amount of the expansion can be accommodated by contraction of a bellows assembly in the reservoir; however, in order to have the bellows assembly of a reasonable size, a dump valve is utilized to dump oil overboard in excess of that which can be accommodated by contraction of the bellows. The dump valve is operable dependent upon the increase in oil volume within the reservoir, rather than the pressure of the oil in the reservoir by actual contact and movement of the dump valve to an open position in response to the volume change sensed by the bellows assembly. Although the invention has been described in terms of a reservoir for storing oil and a hydraulic power circuit, it will be evident that the invention would be applicable to systems using a liquid other than oil.

BEST MODES FOR CARRYING OUT THE INVENTION

Figure 1:
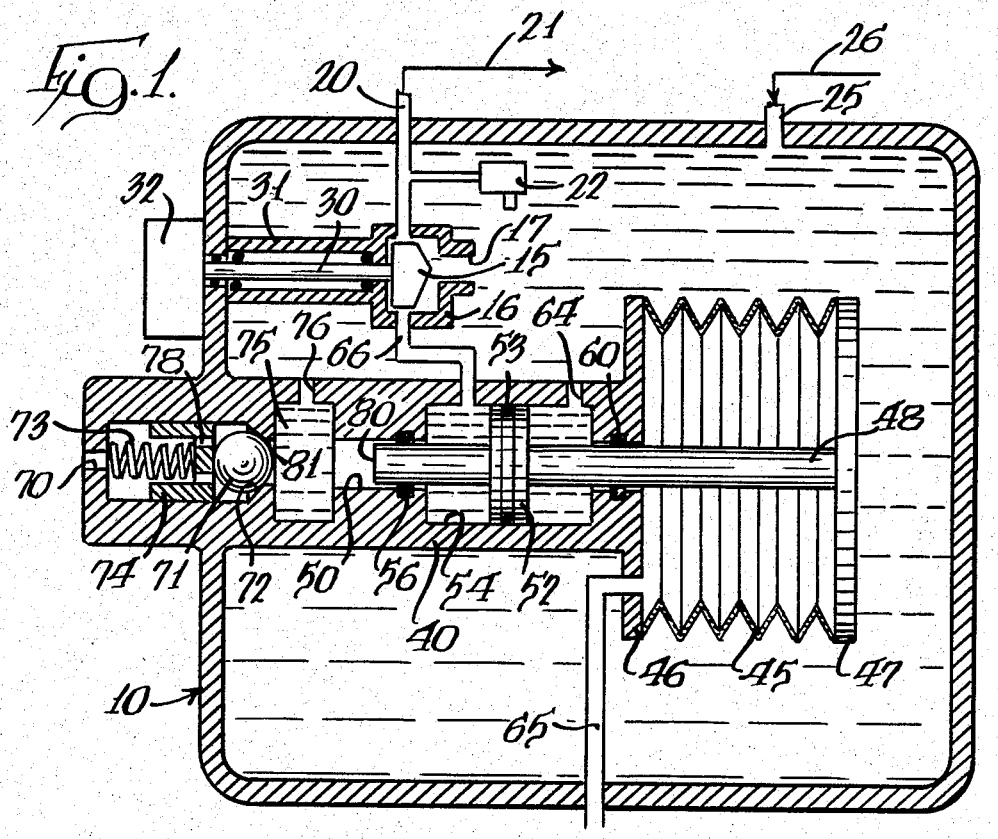
FIG. 1 is a transverse sectional view of an oil supply system with parts broken away and showing one form of the oil volume control device.

One embodiment of the invention is shown in FIG. 1 wherein the oil supply system has a sealed reservoir 10 which is filled with oil. One use of the supply system is for supplying oil to missile actuators, such as missile guidance controls, and therefore the reservoir filled with oil may be subject to storage over a substantial period of time. As known in such systems, a centrifugal pump having an impeller 15 is positioned within the reservoir. The centrifugal pump 15 is shown schematically as mounted within a housing 16 having an inlet 17 for drawing oil from the reservoir and delivering oil under pressure to a line 20 which connects to a user device, such as the missile actuator controls, with oil flowing in the direction of the arrow 21. A relief valve 22 can be set to determine the maximum pressure delivered by the centrifugal pump 15. The oil returns from the user device to an inlet connection 25 to the reservoir, with the flow being in the direction of the arrow 26.

The centrifugal pump has a drive shaft 30 extending through a housing 31 fixed to the interior of the reservoir wall and the drive shaft passes through the wall for connection to a drive means 32, such as a gas-driven turbine.

An elongate support member 40, which may be cylindrical, extends both inwardly and outwardly of the reservoir from a wall thereof and may either be integral therewith, as shown, or formed as a separate member which is mounted to the reservoir wall and sealed thereto. The support member 40 mounts a bellows assembly including an expansible bellows 45 which may be of a conventional construction and of a material, such as steel, and which, at one end, is sealed to a flange 46 on the support member 40 and, at its other end, sealed to a disc 47 which is connected to a rod 48. The rod 48 extends through part of a central elongate opening 50 within the support member 40 and is movable relative thereto and has a piston 52 with a peripheral seal 53 intermediate its ends movable within a cylinder 54 defined by a portion of the support member 40. A pair of O-ring seals 56 and 60 are associated with the rod 48 and function to seal the cylinder 54. One end of the cylinder is open to the reservoir through a passage 64. The interior of the bellows 45 is vented to ambient pressure through vent 65.

A fluid line 66 extends from the pressure outlet of the centrifugal pump 15 to the cylinder 54 whereby pump pressure acts against a face of the piston 52.

In storage, the oil within the reservoir is at an extremely low pressure. Upon start-up of the supply system, the gas-driven turbine 32 is operated to rotate the centrifugal pump which delivers oil under pressure through the line 20 to the user device in the closed oil circuit, with the oil returning to the reservoir through the inlet 25. In order to avoid cavitation of the centrifugal pump 15, pump pressure is applied to the piston 52 to act in a direction to expand the bellows 45 whereby d upon startpressure of oil in the reservoir is increase up. The areas of the piston 52 and the bellows assembly have a ratio which establishes the same ratio of the oil pressure in the reservoir to the outlet pressure of the pump.

The foregoing structure is typical of previously-known supply systems and reservoir structure associated therewith.

The volume control device for limiting the volume of oil in the reservoir includes a dump valve in the form of a spring-urged check valve mounted adjacent one end of the support member 40 and which is normally closed to block flow through a dump port 70. More specifically, the ball check valve has a ball valve member 71 urged against a valve seat 72 by a spring 73 acting on a movable cup-shaped member 74 which seats an end of the spring and engages against the ball valve member 71. A chamber 75 within the support member 40 communicates with the interior of the reservoir through a passage 76 whereby, when the ball check valve opens, there can be overboard flow past the valve seat 72 and through openings 78 in the cup-shaped member 74 ahd the dump port 70. The force of the spring 73 is selected whereby the ball valve member 71 will not move from its seat in response to pressures above the reservoir pressure existing during operation.

The check valve is aligned with the rod 48 whereby as the volume of oil within the reservoir increases, there will be a contraction of the bellows 45 which moves the rod 48 toward the left, as viewed in FIG. 1, and after a predetermined amount of contraction the movement of the rod brings an end 80 of the rod into engagement with the ball valve member 71 to move it from the seat 72. The diameter of the rod 48 is less than the diameter of a passage 81 adjacent the valve seat 72 whereby the rod can move through the passage to unseat the ball valve member and permit flow of oil around the periphery of the rod to the dump port 70.

In operation of the oil supply system with the reservoir having the volume control device, the centrifugal pump 15 is operated to provide oil under pressure to the user device with return of oil to the reservoir. Assuming the relief valve 22 is set to limit the pressure to a value, for example, of 3,000 psi and the area of the bellows assembly exposed to oil within the reservoir is ten times the area of the piston 52 exposed to pump pressure, the system will operate to maintain an oil pressure within the reservoir of approximately 300 psi, by control of the expansion of the bellows 45. As the temperature of the oil increases during operation, the oil volume in the reservoir increases with contraction of the bellows 45 and when the volume increases to the extent to contract the bellows sufficient to have the rod end 80 engage and unseat the ball valve member 71 there is overboard flow of oil from the reservoir through the dump port 70. The amount of contraction of the bellows 45 which will open the check valve can be established to occur before the bellows is fully compressed, thus allowing a reserve bellows stroke to accommodate rapid volume changes that may occur when pairs of user devices, such as a pair of guidance controls having unequal areas exposed to pressure are cycled rapidly.

The force of the spring 73 can render the ball check relatively immune to the pressure of oil within the reservoir and the ball check valve can easily be opened because the bellows assembly has a relatively large area when compared with the area of the ball check valve to provide ample force to open the valve. With this high force margin available and valve hysteresis no longer dependent on design of the ball valve seat, the valve can easily be designed to avoid sharp seats and provide reliable static sealing.

Figure 2:
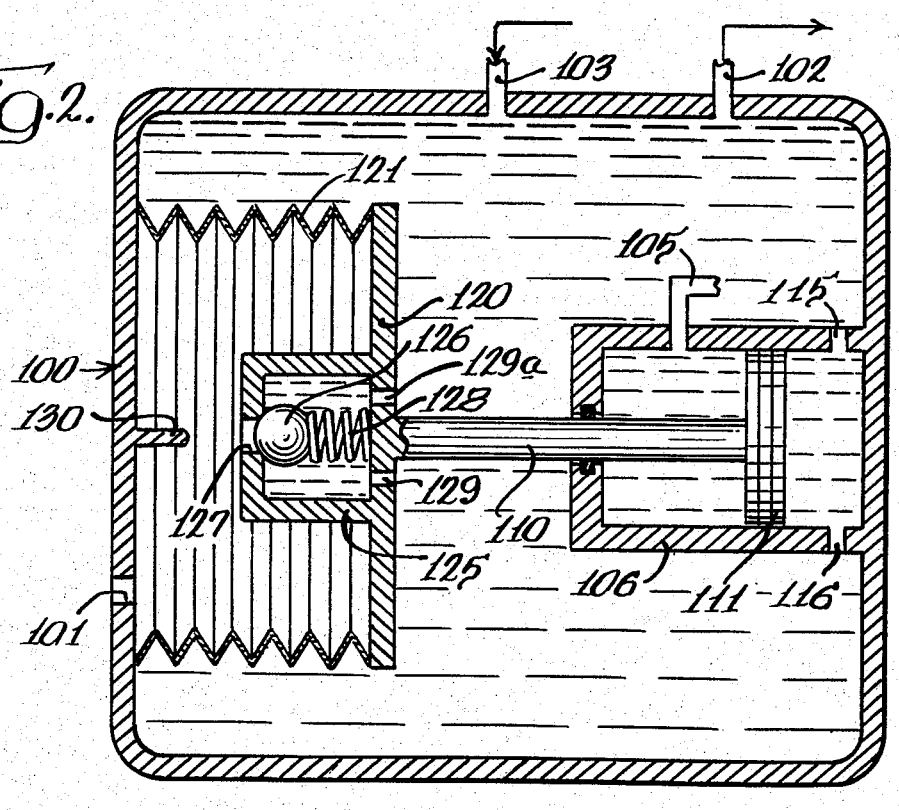
FIG. 2 is a view, similar to FIG. 1, of another embodiment of the invention with parts broken away and with certain parts similar to those shown in FIG. 1 being omitted.

A second embodiment of the invention is shown in FIG. 2 wherein a reservoir 100 has a dump port 101. The reservoir has an outlet 102 for pressure fluid delivered by a pump and an inlet 103 for oil returning to the reservoir. The reservoir has a centrifugal pump (not shown) similar to that shown in FIG. 1, with the centrifugal pump supplying the outlet 102 and also supplying a conduit 105 leading to a cylinder 106 secured to a wall of the reservoir. A rod 110 has a piston 111 within the cylinder 106 whereby fluid at pump outlet pressure can be applied to a face of the piston 111. The back side of the piston is exposed to pressure of oil within the reservoir through ports 115 and 116 in the wall of the cylinder 106.

The rod 110 has a disc 120 of a bellows assembly to which one end of a bellows 121 is secured with the opposite end of the bellows being secured to a wall of the reservoir. The disc 120 mounts a cup-shaped member 125 in which a spring-urged ball check valve is positioned. A ball valve member 126 is urged by a spring 128 against a valve seat formed in a passage 127. Oil within the reservoir communicates with the interior of the cup-shaped member through ports 129 and **129*a* in the disc 120. A rod 130 extends inwardly from a wall of the reservoir and is in alignment with the passage 127 in the cup-shaped member 125**.

The structure shown in FIG. 2 generally operates in the same manner as the structure shown in FIG. 1. Upon start-up, pressure oil delivered to the cylinder 106 acts on the piston 111 to expand the bellows 121 and increase the pressure of oil within the reservoir. As the volume of oil increases, the bellows 121 contracts to move the disc 120 toward the left, as viewed in FIG. 2, and, after a predetermined amount of contraction, the ball valve member 126 contacts the rod 130 with further movement opening the check valve whereby oil can flow from the reservoir through the ports 129 and **129*a*, passage 127 and the dump port 101. In the embodiment of FIG. 2, the check valve does not seat against pressure of oil in the reservoir and therefore the spring 128 need not have a closing force as large as that provided by the spring 73 in the embodiment of FIG. 1**.

It will be evident from the foregoing that reservoirs have been provided which can store oil for a long period without leakage because the means provided for dumping oil overboard are not sensitive to the pressure of oil within the reservoir.

The dump valve in both embodiments could, alternatively, be a check valve of the poppet type with a soft O-ring seat to further minimize the potential for leakage.

I claim:

1. A supply system for a closed oil circuit comprising, an oil reservoir for holding oil under pressure, means in the circuit for pumping oil from the reservoir for use and thereafter returning the pumped oil to the reservoir, a normally closed dump valve for discharging oil from the reservoir, and means responsive to a predetermined increase in volume of oil in the reservoir for opening the dump valve including a bellows assembly in the reservoir which contracts upon an increase in volume of oil in the reservoir.

2. A supply system as defined in claim 1 wherein said responsive means further includes a member subject to the pressure of pumped oil for opposing contraction of said bellows assembly.

3. A supply system as defined in claim 1 wherein said dump valve is a spring-loaded check valve, and said responsive means comprises a movable rod, said bellows assembly being connected to said rod, and said check valve and rod being positioned whereby movement of said rod in response to a predetermined contraction of the bellows assembly causes the check valve to open.

4. A supply system as defined in claim 1 wherein said dump valve is a spring-loaded check valve, and said responsive means comprises, a movable rod, said bellows assembly being operatively connected to said rod whereby a predetermined contraction of said bellows assembly moves said rod into engagement with the check valve for opening thereof, and a piston on said rod exposed on one side to the pressure of pumped liquid to oppose contraction of said bellows.

5. A supply system as defined in claim 1 wherein said dump valve is a check valve, and said responsive means further comprises a movable rod operatively connected to said bellows assembly, and a dump port opening to the interior of the bellows assembly.

6. A volume control device for an oil reservoir which holds oil under pressure comprising, a container defining the reservoir, a dump port for flow of oil from the reservoir, a check valve positioned to prevent flow of oil through the dump port and spring-urged to a closed position against the pressure of oil in the reservoir, a movable rod in said reservoir movable to a position to engage add open the check valve whereby oil can flow through said dump port, a bellows assembly connected to said rod whereby an increase in oil volume in the reservoir contracts the bellows assembly to move the rod, and pressure-responsive means connected to said rod and operative to oppose contraction of said bellows assembly.

7. A volume control device as defined in claim 6 wherein the bellows assembly has a large area as compared to the area of the check valve whereby a large force is created to act against the spring-urged check valve.

8. A volume control device as defined in claim 6 wherein said bellows assembly includes a bellows and said rod is moved to said position to open the check valve before said bellows has fully contracted to provide a reserve amount of bellows contraction to accommodate rapid oil volume changes.

9. A volume control device for a reservoir which holds liquid under pressure comprising, a dump port for flow of liquid from the reservoir, a normally closed check valve positioned to prevent flow of liquid through the dump port, a bellows assembly in said reservoir whereby an increase in liquid volume in the reservoir contracts the bellows assembly, pressureresponsive means operative to oppose contraction of said bellows assembly, and means operable by a predetermined contraction of the bellows assembly to open the check valve.

10. A supply system for a closed oil circuit having a sealed reservoir stored full of oil and a pump having an inlet connected to the reservoir for supplying oil under pressure to a user device with return of oil from the user device to the reservoir comprising, an expansible bellows positioned in the reservoir, a rod connected to the bellows, a piston and cylinder in said reservoir with said piston being on said rod, means connecting the pressure side of the pump to said cylinder whereby oil under pressure acts on said piston in a direction to expand said bellows to increase the pressure of the oil in the reservoir upon start-up of the pump and resists contraction of the bellows during operation, and volume-responsive means for limiting the increase of volume of oil in the reservoir during operation of the pump.

11. A supply system as defined in claim 10. wherein said means for limiting the increase of oil volume in the reservoir comprises an outlet from the reservoir, a normally closed check valve in said outlet, and means operable by movement of the rod after a predetermined contraction of the bellows for opening said check valve.

12. A supply system as defined in claim 11 wherein said check valve is opened by contact of said rod therewith.

13. A supply system as defined in claim 10 wherein said bellows and piston have their areas related in a ratio to have the oil pressure in the reservoir during operation a predetermined amount less than the pressure of the pumped oil.

14. A liquid volume control device for a sealed reservoir stored full of liquid and used with a pump having an inlet connected to the reservoir for supplying liquid under pressure to a user device with return of liquid from the user device to the reservoir comprising, an expansible member positioned in the reservoir, a piston and cylinder in said reservoir, means connecting the pressure side of the pump to said cylinder whereby liquid under pressure urges said piston in one direction, means interconnecting the expansible member and the piston to resist contraction of said expansible member during operation, and means responsive to contraction of the expansible member for limiting the increase of volume of liquid in the reservoir during operation of the pump.

15. A supply system as defined in claim 14 wherein said means for limiting the increase of liquid volume in the reservoir comprises an outlet from the reservoir, a normally closed check valve in said outlet, and means operable after a predetermined contraction of the expansible member for opening said check valve.

16. A method for controlling the volume of oil in a reservoir which during operation holds oil under pressure and supplies oil to a pump in a closed circuit which returns the oil to the reservoir by use of a bellows assembly connected to a member- and which contracts to move the member to open a dump valve for dumping oil from the reservoir upon a predetermined increase of oil volume comprising, positioning the bellows assembly in the reservoir with said member positioned to, upon movement, open the dump valve whereby an increase in oil volume causes contraction of the bellows assembly to open the dump valve, and applying the pressure of pumped oil to said member to oppose contraction of said bellows assembly whereby contraction of said bellows assembly is not dependent on the pressure of oil within the reservoir.

17. A method for controlling the volume of liquid in a reservoir which during operation holds liquid under pressure by use of a bellows assembly connected to a member and which contracts to move the member to open a dump valve for dumping liquid from the reservoir upon a predetermined increase of liquid volume comprising, positioning the bellows assembly in the reservoir whereby an increase in liquid volume causes contraction of the bellows assembly, and exerting a force on said member to oppose contraction of said bellows assembly with said force related to the liquid pressure in the reservoir whereby contraction of said bellows assembly is not dependent on the pressure of liquid within the reservoir.

* * * * *